United States Patent [19]

Langlois et al.

[11] Patent Number: 4,753,214

[45] Date of Patent: Jun. 28, 1988

[54] CRANKCASE VENTILATION SYSTEM FOR MOTOR VEHICLES

[75] Inventors: Karl Langlois, Weissach-Flacht; Manfred Batzill, Neuhausen, both of Fed. Rep. of Germany

[73] Assignee: Dr. Ing. h.c.F. Porsche Aktiengesellschaft, Weissach, Fed. Rep. of Germany

[21] Appl. No.: 60,867

[22] Filed: Jun. 12, 1987

[30] Foreign Application Priority Data

Jul. 26, 1986 [DE] Fed. Rep. of Germany ..... 3625376

[51] Int. Cl.[4] ..... F02M 25/06; F01M 13/02

[52] U.S. Cl. ..... 123/572

[58] Field of Search ..... 123/572, 574, 41.86

[56] References Cited

U.S. PATENT DOCUMENTS

| | | | |
|---|---|---|---|
| 2,311,036 | 2/1943 | Dressler | 123/41.86 |
| 3,059,628 | 10/1962 | Linn | 123/572 |
| 3,372,685 | 3/1968 | Bestland et al. | 123/41.86 |
| 4,011,846 | 3/1977 | Gagliardi | 123/572 |

FOREIGN PATENT DOCUMENTS 3627376 10/1987 Fed. Rep. of Germany .

OTHER PUBLICATIONS

Porsche, Information Service 1985, 928S USA, Jun. 1985, pp. 30 & 31.

*Primary Examiner*—Willis R. Wolfe
*Assistant Examiner*—M. Macy
*Attorney, Agent, or Firm*—Barnes & Thornburg

[57] ABSTRACT

A crankcase ventilation system for motor vehicles comprises a main ventilation system and a safety ventilation system, in which at an air guiding housing of the intake system, connecting pieces are arranged to which the lines of the two systems are connected. So that the connection between the lines of the two systems and the air guiding housing is simplified with respect to construction and also requires little space, a joint connecting piece having connecting pipe sections for the lines of both systems is provided at the air guiding housing. Separate ducts lead away from the connecting pipe sections and extend to remotely arranged outlet openings. The outlet openings of both ducts—seen in flow direction—extend at a distance from one another.

15 Claims, 3 Drawing Sheets

CRANKCASE VENTILATION SYSTEM FOR MOTOR VEHICLES

BACKGROUND AND SUMMARY OF THE INVENTION

The invention relates to a crankcase ventilation system for motor vehicles, in which the crankcase gases are returned from the cylinder block and crankcase into an intake system of an internal-combustion engine via a main ventilation system or a safety ventilation system. Connecting pieces are arranged at an air guiding housing of the intake system for connecting lines of the main ventilation system and of the safety ventilation system.

In the case of a known crankcase ventilation system (Service Information 1985, Porsche 928 S, USA, Pages 30 and 31) of the initially mentioned type, two connecting pieces arranged at a spacing from one another are provided at the air guiding housing of the intake system, one connecting piece being connected with the line of the main ventilation system and the other connecting piece being connected with the line of the safety ventilation system. This crankcase ventilation system functions well, but the construction of the air guiding housing with the two connecting pieces is costly. In addition, the two connecting pieces require considerable space at the air guiding housing so that the narrow space conditions that anyhow are present particularly in the area of the intake system of a four-valve engine are limited even more.

It is an objective of the invention to take such measures at a crankcase ventilation system that the connection between the lines of the two systems and the air guiding housing is simplified with respect to construction and also requires little space.

According to the invention, this objective is achieved by providing a common connecting piece that connects both crankcase ventilation systems with the air guide housing. In certain preferred embodiments, the common connecting piece has outlet openings to the air guide housing that are spaced from one another in the vented gas flow direction. The preferred embodiments of the invention have a unitary connecting piece with a Y-shape, the arms of the y connecting respectively to the two ventilation systems.

The main advantages achieved by means of the invention are that by the arrangement of only one connecting piece for the lines of both systems, a simple and space-saving connection is established between the lines and the air guiding housing. By means of the separate ducts inside the connecting piece for the two systems and the outlet openings that are offset with respect to one another, a good functioning of the crankcase ventilation system is achieved. When the outlet opening of the main ventilation system is, for example, closed by ice, the safety ventilation system with the outlet opening that in sections projects into the inside of the air guiding housing will take over the crankcase ventilation until the closed connection of the main ventilation system in the air guiding housing has become penetrable again after the engine operating temperature or a sufficient engine compartment temperature has been reached. The connecting piece can be constructed in an easy and cost-effective way. Because of the locking connection between the connecting piece and the short pipe section of the air guiding housing in certain preferred embodiments, a rapid and easy mounting of the connecting piece is ensured.

Other objects, advantages and novel features of the present invention will become apparent from the following detailed description of the invention when considered in conjunction with the accompanying drawings.

DETAILED DESCRIPTION OF THE DRAWINGS

Figure 1:
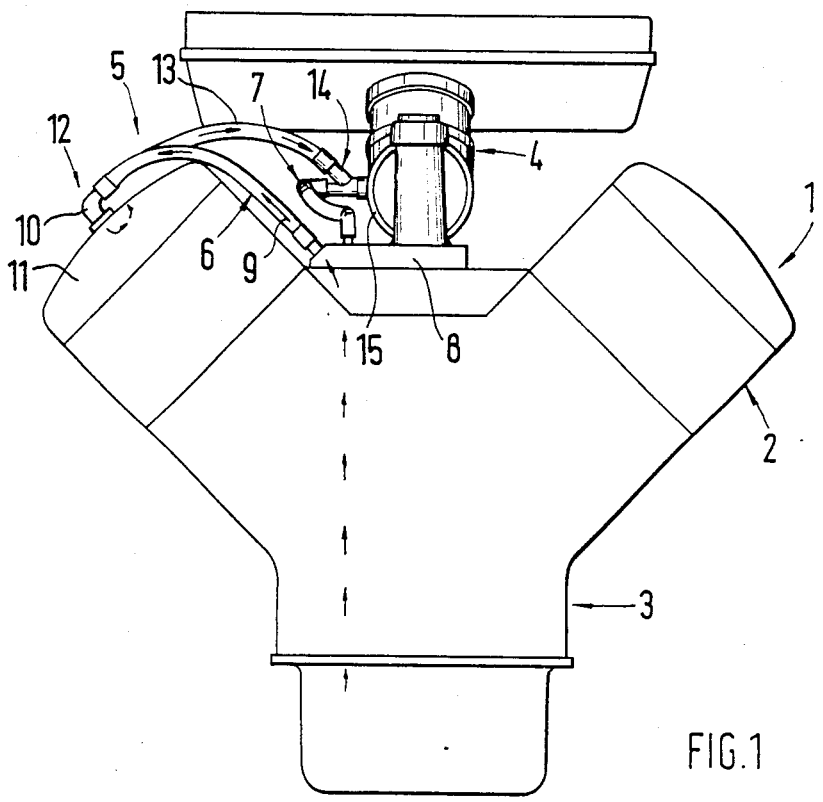
FIG. 1 is a frontal schematic view of an internal-combustion engine having a crankcase ventilation system constructed in accordance with a preferred embodiment of the invention.

A multicylinder internal-combustion engine 1 for a motor vehicle comprises a cylinder head 2 and a cylinder block and crankcase 3. For the return of the crankcase gases from the cylinder block and crankcase 3 into an intake system 4 of the internal-combustion engine 1, a crankcase ventilation system is provided that is composed of a main ventilation system 6 and a safety ventilation system 7.

In the case of the main ventilation system 6, the crankcase gases (blow-by gases) move from the cylinder block and crankcase 3 into an oil filler neck 8. Subsequently, they pass through a line 9 that is connected via an angle connection 10 with a cylinder head cover 11 that penetrates it. Inside the cylinder head cover 11, between the two central cylinders, an oil separator is arranged that is not shown in detail. After flowing through the oil separator, the crankcase gases, via another angle connection 12 and a line 13 arranged outside the cylinder head cover, reach a connecting piece 14 that is arranged at an air guiding housing 15 of the intake system 4. Inside the angle connection 12, a throttle is inserted that is not shown.

When the main ventilation system 6 fails, for example, caused by icing (=closing of the throttle bore and/or of the outlet opening of the connecting piece), the excessive pressure in the cylinder block and crankcase 3 will rise because of lacking pressure balance and the safety ventilation system 7 will be actuated. In the case of the safety ventilation system 7, the crankcase gases, via an opening of the cylinder block and crankcase 3 that is not shown, will reach the oil filler neck 8. At 16, a safety valve is inserted into a connection of the oil filler neck 8 that opens at an excessive pressure of 80 to 100 mbar. When the safety valve is open, the crankcase gases, via a line 17, flow directly to the air guiding housing 15 (FIG. 2).

Figure 2:
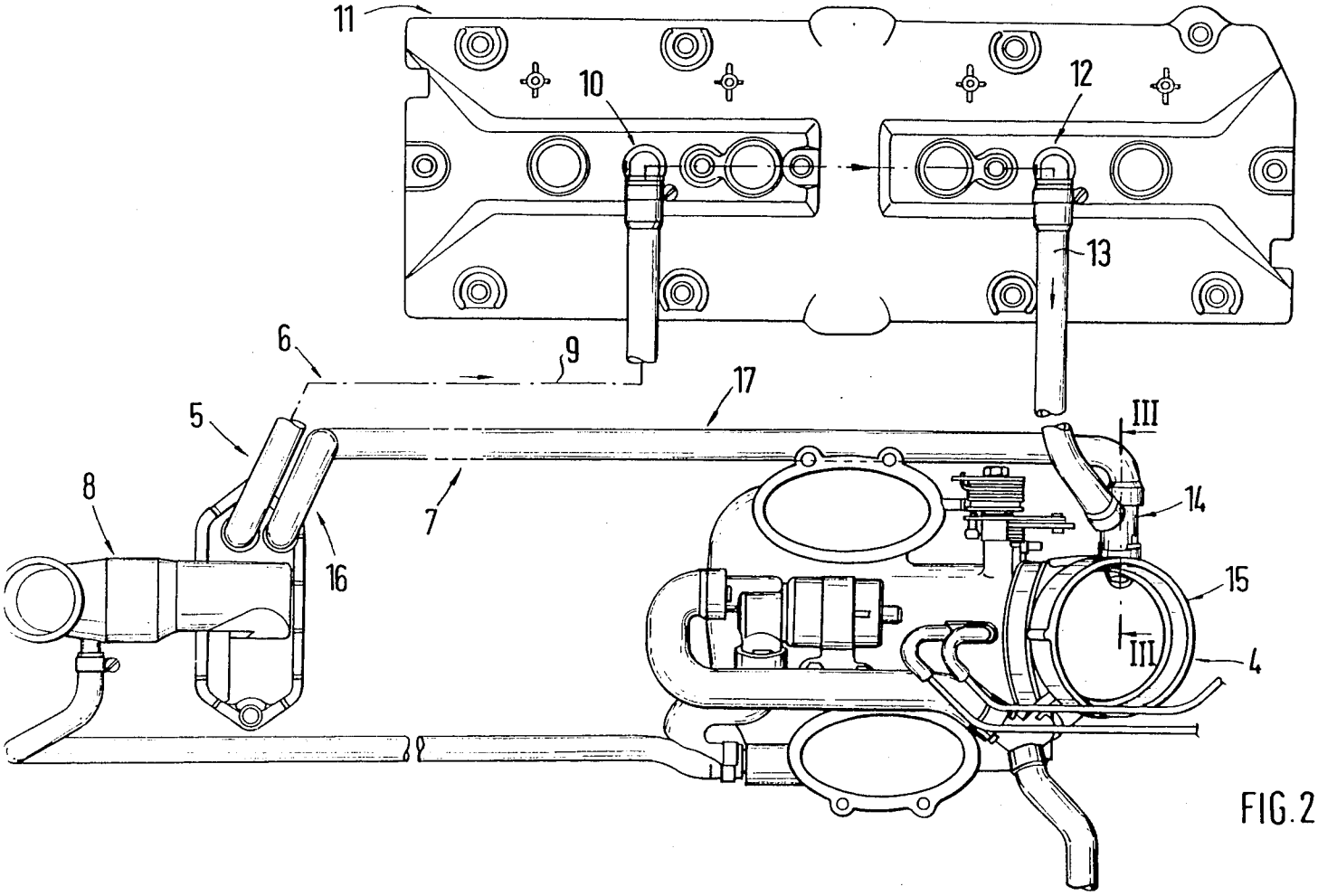
FIG. 2 is a diagrammatic view from above onto the crankcase ventilation system of FIG. 1.
Figure 3:
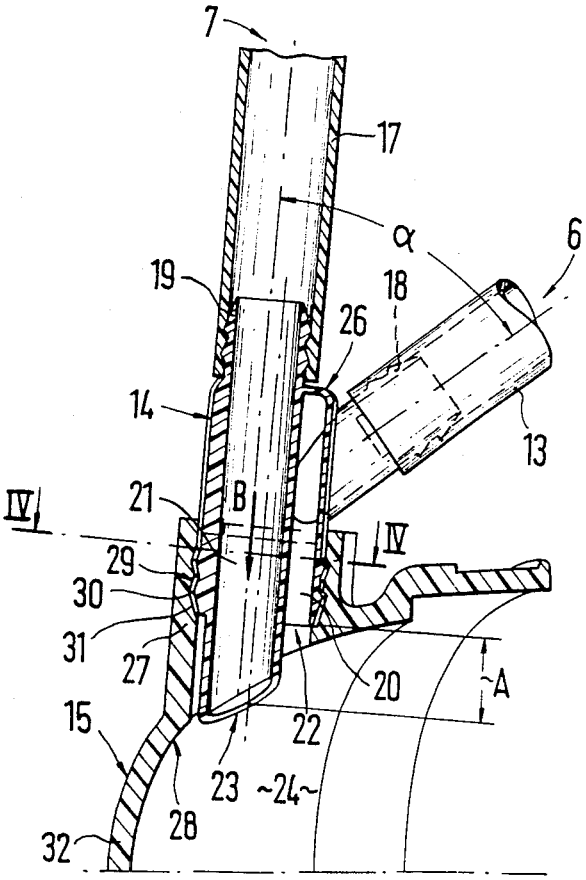
FIG. 3 is a sectional view taken along the Line III—III of FIG. 2.
Figure 4:
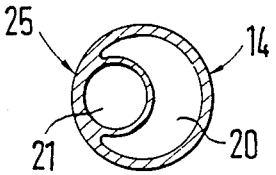
FIG. 4 is a sectional view taken along the Line IV—IV of FIG. 3.

According to FIGS. 2 and 3, a joint connecting piece 14 having respective connecting pipe sections 18, 19 for the lines 13, 17 of the two systems 6, 7 (main ventilation system and safety ventilation system) is provided at the air guiding housing 15, in which case separate ducts 20, 21 lead away from the two connecting pipe sections 18, 19 and extend to remotely arranged outlet openings 22, 23. The two connecting pipe sections 18, 19 extend at an angle to one another. The outlet openings 22, 23 of the two ducts 20, 21, seen in flow direction B, extend at a distance A to one another and lead into the air guiding housing 15. Duct 21 of the safety ventilation system 7 that is shaped in a straight line extends as a continuation of the connecting pipe section 19 and with its free end containing the opening 23, in sections, projects into the interior space 24 of the air guiding housing 15. The cross-section of the duct 21, seen over its whole longitudinal course, is constant. The duct 20 of the main ventilation system 6 surrounds the duct 21 of the safety ventilation system 7 in sections, in which case the two ducts 20, 21 are arranged eccentrically with respect to one another. Wall sections of the interior duct 21 and of the exterior duct 20 are merged together at 25. The exterior duct 20 has an approximately crescent-shaped cross-section (FIG. 4).

The connecting pipe section 18 of the main ventilation system 6 extends at an angle to the connecting duct 20, the side 26 of the duct 20 that is opposite the outlet opening 22 being developed to be closed. The outlet opening 22 of the main ventilation system 6, seen in flow direction B, is arranged in front of the outlet opening 23 of the safety ventilation system 7, in such a way that the outlet opening 22 of the main ventilation system 6 extends in the area of a connecting pipe section 27 of the air guiding housing 15. The outlet opening 23 of the safety ventilation system 7 extends approximately in parallel to an interior limiting wall 28 of the air guiding housing 15.

The approximately Y-shaped connecting piece 14 is inserted into the molded-on connecting pipe section 27 of the air guiding housing 15 and connected with it via a locking connection 29. The locking connection 29 comprises groove-shaped molded-on parts 30 at the connecting piece 14 that engage in corresponding recesses 31 of the connecting pipe section 27. The air guiding housing 15 is formed by an air guiding scoop 32 developed in the shape of a pipe section connection that is arranged between an air mass meter and a throttle valve connection piece, namely below a throttle valve that is not shown.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A crankcase ventilation system for motor vehicles, in which the crankcase gases are returned from the cylinder block and crankcase into an air guiding housing of an intake system of an internal-combustion engine via a main ventilation system or a safety ventilation system for accommodating blockage of the main ventilation system, comprising a main intake line connected to the main ventilation system and the crankcase, a safety intake line connected to the safety ventilation system and the crankcase in by passing relation to the main intake line, and a common connecting piece for connecting the air guiding housing with both the main intake line and the safety intake line.

2. A crankcase ventilation system according to claim 1, wherein said common connecting piece includes respective separate ducts which lead away from connecting pipe sections for the main intake line and the safety intake line, said separate ducts extending to remotely arranged outlet openings, and wherein outlet openings of the ducts, seen in flow direction, extend at a distance to one another and lead into the air guiding housing.

3. A crankcase ventilation system according to claim 2, wherein the connecting piece is developed to be approximately Y-shaped.

4. A crankcase ventilation system according to claim 2, wherein a duct of the safety ventilation system extends as a continuation of a pertaining connecting pipe section and has a straight shape.

5. A crankcase ventilation system according to claim 2, wherein a duct of the main ventilation system surrounds a duct of the safety ventilation system.

6. A crankcase ventilation system according to claim 5, wherein the two ducts of the main ventilation system and the safety ventilation system are arranged eccentrically with respect to one another.

7. A crankcase ventilation system according to claim 5, wherein wall sections of the ducts of the main ventilation system and the safety ventilation system rest against one another along portions thereof.

8. A crankcase ventilation system according to claim 2, wherein a outlet opening of the main ventilation system, seen in flow direction, is arranged in front of an outlet opening of the safety ventilation system.

9. A crankcase ventilation system according to claim 1, wherein a duct of the main ventilation system and an assigned connecting pipe section are placed against one another at an angle.

10. A crankcase ventilation system according to claim 2, wherein a duct of the main ventilation system is developed to be closed at the side that is opposite its outlet opening.

11. A crankcase ventilation system according to claim 2, wherein the connecting piece is inserted into a pipe section of the air guiding housing and is connected with it via a locking connection.

12. A crankcase ventilation system according to claim 2, wherein a duct of the safety ventilation system, with its free end containing an outlet opening, projects with portions thereof into the interior of the air guiding housing.

13. A crankcase ventilation system according to claim 2, wherein an end of the duct containing an outlet opening is arranged outside an interior limiting wall in the area of the pipe section.

14. A crankcase ventilation system according to claim 2, wherein the air guiding housing is formed by an air guiding scoop arranged between an air mass meter and a throttle valve pipe section.

15. A crankcase ventilation system according to claim 1, wherein said common connecting piece is a unitary one-piece molded part that includes respective main intake and safety intake ducts connecting the main intake line and the safety intake line to different outlet openings in the air guiding housing.

* * * * *